US006550208B2

(12) United States Patent
Nanayakkara

(10) Patent No.: US 6,550,208 B2
(45) **Date of Patent: *Apr. 22, 2003**

(54) CONSTRUCTIONAL COMPONENTS FOR USE IN A WALL STRUCTURE

(76) Inventor: Lakdas Nanayakkara, 2211 NE. 54th St., Fort Lauderdale, FL (US) 33308

( * ) Notice: Subject to any disclaimer, the term of this patent is extended or adjusted under 35 U.S.C. 154(b) by 0 days.

This patent is subject to a terminal disclaimer.

(21) Appl. No.: 09/932,958

(22) Filed: Aug. 21, 2001

(65) Prior Publication Data

US 2002/0046529 A1 Apr. 25, 2002

Related U.S. Application Data

(63) Continuation-in-part of application No. 09/546,918, filed on Apr. 11, 2000, which is a continuation-in-part of application No. 08/924,517, filed on Sep. 5, 1997, now Pat. No. 6,105,330.

(51) Int. Cl.[7] ..... E04B 1/04

(52) U.S. Cl. ..... 52/606; 52/604; 52/309.12; 52/223.7; 52/590.2; 52/592.6; 52/506.02

(58) Field of Search ..... 52/604, 300, 506.02, 52/98, 606

(56) References Cited

U.S. PATENT DOCUMENTS

| | | | | |
|---|---|---|---|---|
| 3,325,956 A | | 6/1967 | Moraetes | |
| 4,186,540 A | | 2/1980 | Mullins | |
| 5,899,040 A | | 5/1999 | Carrato | |
| 5,930,958 A | * | 8/1999 | Stanley | 52/284 |
| 6,065,265 A | * | 5/2000 | Stenekes | 52/100 |
| 6,105,330 A | * | 8/2000 | Nanayakkara | 52/590.2 |
| 6,244,009 B1 | * | 6/2001 | Cerrato | 52/223.7 |

FOREIGN PATENT DOCUMENTS

| | | |
|---|---|---|
| GB | 176031 | 2/1922 |
| GB | 550746 | 1/1943 |

* cited by examiner

*Primary Examiner*—Carl D. Friedman
*Assistant Examiner*—Basil Katcheves
(74) *Attorney, Agent, or Firm*—M. K. Silverman

(57) ABSTRACT

A constructional component for a wall structure capable of resisting high gravity and lateral loads, both uniform and cyclical, is defined by a partially hollow building block having a generally solid rectangular exterior configuration in which one entire end surface of the building block exhibits a positive deep key geometry and the opposing end surface exhibits a negative deep key geometry, complemental to the positive geometry of the opposite end. Deep key interlocks also exist between opposing horizontal block surface. As partition between vertical cavities of the block may define a Z-shape in horizontal cross-section. There is resultingly created a substantially rigid and load-resilient interlock between vertical and horizontal complemental surfaces when joined as components of a wall structure.

28 Claims, 13 Drawing Sheets

CONSTRUCTIONAL COMPONENTS FOR USE IN A WALL STRUCTURE

REFERENCE TO RELATED APPLICATION

This case is a continuation-in-part of application Ser. No. 09/546,918, filed Apr. 11, 2000 entitled Constructional Brick, which is a continuation-in-part of application Ser. No. 08/924,517, filed Sep. 5, 1997, now U.S. Pat. No. 6,105,330.

BACKGROUND OF THE INVENTION

1. Field of Invention

The present invention relates to interlocking building blocks for the construction of a building or wall structure.

It is common construction practice to erect building walls, as well as certain categories of free-standing walls, using concrete blocks of a solid rectangular configuration in which each block exhibits a plurality of cavities and external planes at all six sides thereof. Such blocks are, as is well known, laid-up in courses, typically by placing mortar, by trowel, on the top of the blocks and then positioning the blocks of the next course upon the lower course. However, as described below, some systems of inter-locking blocks exist which reduce or eliminate the need for such mortar. The instant invention particularly addresses the need for building blocks useful components of an interlocking building block system capable of resisting high lateral loads, of a both uniform and cyclical nature.

2. Description of the Prior Art

The prior art has recognized the need for, and value of, a building block system having interlocking elements at the horizontal interface between courses of the building blocks. The rationale for the use of such interlocking between horizontal planes of building blocks has, typically, been to eliminate or minimize the need for mortar between the courses thereof.

Such structures and systems appear in the prior art as U.S. Pat. No. 4,186,540 (1980) to Mullins, entitled Interlocking Cementitious Building Blocks and U.S. Pat. No. 3,325,956 (1967) to Moraetes, entitled Key Element for Concrete Blocks.

All building blocks of the instant type include a solid volume, also known as a web, which separate two vertical cavities. In the instant invention, this solid volume or web narrows in the negative (downward vertical) direction. No such narrowing of the web or partition exists in the reference to Mullins. Rather, it is only the upper mouth, known as a corbel, which slopes in a negative z-direction. More particularly, the teaching of Mullins is limited to that of a shape of the mouth of the vertical cavities which assists in the removal of retractable cores therefrom after the molding of such a block has occurred. Accordingly, to the extent that any narrowing of the web or partition Mullins occurs in the negative direction, such narrowing plays no role in the functionality of any wall system formed of blocks thereof.

With respect to Moraetes cited above, the teaching thereof is that of core openings which are tapered to permit ready extraction of the cores of molds thereof during manufacture of the block. That is, the vertical cavities of Moraetes do not bear any particular relationship to the structure of the webs or partition separating the vertical cavities thereof. Rather, the teaching of Moraetes relates only to its use of so-called key sections, which use is facilitated by the core openings shown therein. As such, the system of Moraetes is one is which a separate key or lock element, having completely different mechanical principles from that of Applicant's system, is used to achieve some of the objectives of vertical and horizontal stability set forth herein. It is therefore to be appreciated that a system of the type of Applicant's cannot be achieved by Moraetes, either alone or in combination with any other art known to the within inventor. Further, the art of record does not suggest the particular location of the interior cavity ledges of the component block structure of this invention. Without the particular geometry of the ledge structure of the vertical cavity walls of the inventor's constructional components it is not possible to achieve wall structures which are structural or functional equivalents of those that can be constructed with inventor's constructional components, this as is more particularly set forth below.

The inventor is also aware of United Kingdom Patent No. 550,745 (1941) to Rigby which teaches a proportionality of interlock elements which is completely different from that of the present invention. More particularly, Rigby, as is the case in essentially all prior art known to the inventor, is lacking in the deep key interlock features of the invention which are set forth herein.

The prior art is also reflected in United Kingdom Patent No. 176,031 (1922) to Deyes which shows the use of rebars in combination with horizontal plane key interlocks of brick components.

More recent art in this field is represented by U.S. Pat. No. 5,899,040 (1999) to Cerrato and U.S. Pat. No. 5,930,958 to Stanley. These references do not disclose construction blocks interlocking in three dimensions as is taught by my invention.

It is further noted that little of the above prior art fully addresses or suggests the need or value of a building block interlock structure between the vertical surfaces of building blocks within courses or rows, apparently because of a lack of recognition of the need for structures that could provide resistance against unusual lateral loads that might be encountered by a wall structure formed of building blocks. However, the extent to which the forces of nature can impact upon the integrity of apparently massive structures, such as building blocks/masonry wall structures, as been long know to architects and structural engineers that have been active in geographical areas prone to high velocity winds and earthquakes. High lateral loads may, as well, result from the horizontal component of truss-type loading upon a wall which is in truss-like communication with roof-beams and other transverse members of a given mechanical system.

The instant invention, accordingly, addresses the long-felt need in the art for a constructional component adapted for use in a wall system capable of resisting such high lateral loads, regardless of the origin thereof.

SUMMARY OF THE INVENTION

A constructional component for a wall system definable in an xyz Cartesian coordinate system capable of resisting high gravity and lateral loads, both uniform and cyclical. The component comprises a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface of each building block comprises a positive y-axis deep key geometry and each opposing xz end surface thereof comprises a negative y-axis deep key geometry complementally interlockable to said positive geometry of an opposite xz surface, in which a ratio of the x-axis width of a base of each positive and negative deep key geometry of each opposing xz end surface comprises at least twenty percent of the entire y-axis width of each block, in which each y-axis deep key dimension of said respective deep key geometries also comprises a range of about eight to about twenty five percent of the x-axis dimension of said block, in which said block includes a plurality of vertical cavities extending through the entire z-axis length thereof, said cavities separated by a web portion, said cavities each including (i) a rectilinear recess at an upper xy surface of said block, said recess defining, in a xz plane cross section, a shallow U-shaped negative sub-platform, homologous with said recess, beneath and co-parallel with an xy top surface of said block, in which a vertical z-axis of said web begins at said negative sub-platform, and (ii) an opposite and lower xy surface of said block, at an opposite end z-axis end of said web, having a projecting positive sub-platform co-parallel with said negative sub-platform and complementally interlockable into adjoining negative sub-platforms of like blocks of vertically adjacent courses of blocks within said wall structure, each of said sub-platforms having a z-axis dimension in a range of about five to about twenty five percent of the x-axis dimension of said block, whereby a substantially rigid and load-resistant interlock between horizontally and vertically contiguous blocks, when joined as a component of a wall system, is resultant therefrom.

It is accordingly an object of the invention to provide a building block suitable for use as a constructional component of the wall structure adapted for resistance to high lateral loads, both uniform and cyclical.

It is another object to provide a constructional component of a wall system particularly adapted to resist lateral loads resultant from earthquakes, hurricanes, or pre-defined lateral loads within a truss system.

It is a further object of the invention to provide a constructional component providing enhanced resistance to high lateral loads in both the vertical and horizontal planes of interlock between such constructional components.

It is a yet further object to provide a constructional component of the above type wherein the topmost course of a wall thereof may be readily secured to the roof of a building.

It is a still further object of the invention to provide a constructional component of the above type having a substantially reduced mortar requirement between the horizontal interlock surface thereof.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 3:
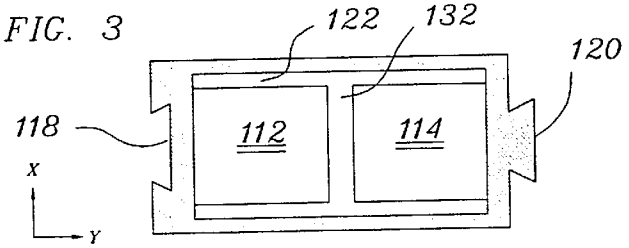
FIG. 3 is a horizontal cross-sectional view taken along Line 3—3 of FIG. 1.
Figure 2:
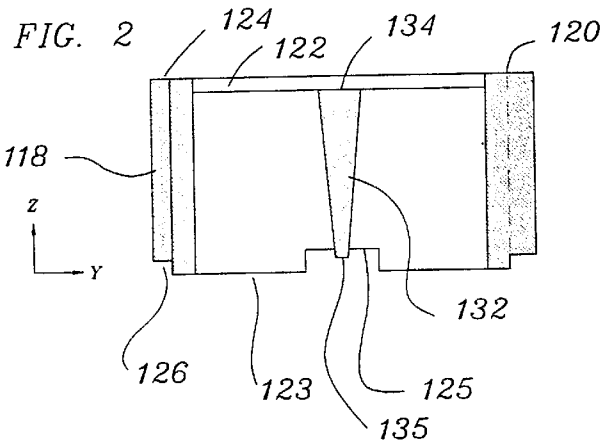
FIG. 2 is a vertical cross-sectional view thereof taken along Line 2—2 of FIG. 1.
Figure 1:
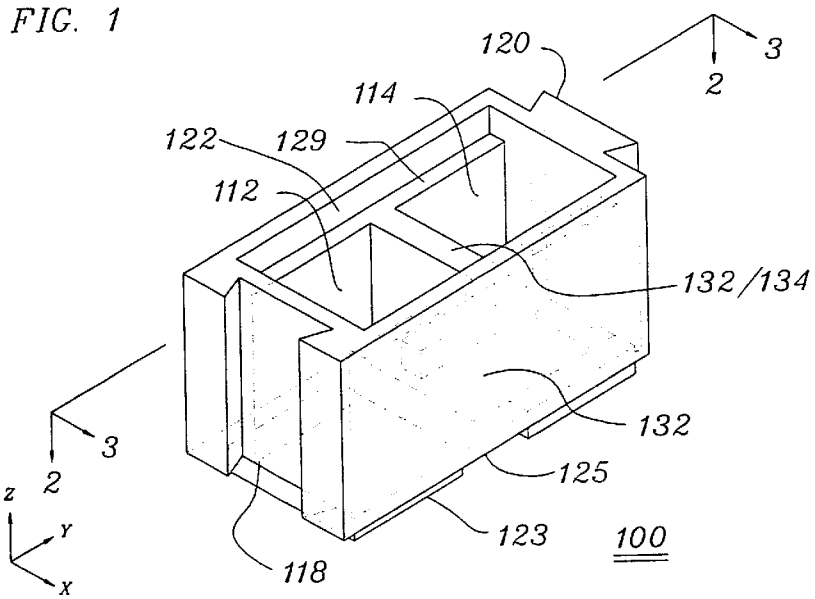
FIG. 1 is a perspective view of a first embodiment of the present invention.

Shown in FIGS. 1 to 3 is a first embodiment of the inventive constructional component for a wall system capable of resisting high gravity and lateral loads, both uniform and cyclical. As may be noted in the legend to the left of FIG. 1, the constructional component is definable in terms of a xyz Cartesian coordinate system, this as is more fully set forth below. The inventive block 100 is formed of a constructional material and having a generally rectangular configuration definable in said xyz coordinate system. An x-axis thereof defines the width axis of the block and thereby of the wall structure of which the blocks will become a component. A y-axis thereof defines the directionality of the wall structure, and a z-axis defines a vertical axis of the block and therefore of the wall structure.

It is to be understood that one xz end surface of each building block comprises a positive xz axis deep key geometry 120 and at each opposing xz end surface thereof comprises a negative y-axis deep key geometry 118 that is complementally interlockable with a horizontally contiguous like block within a wall system formed of such blocks. It is to be noted that a ratio of the x-axis base, that is, (see FIG. 3) the base in the xz plane of each positive and negative deep key geometry 118 and 120 respectively, comprises at least twenty percent of the entire x-axis width of each block, and the y-axis deep key dimension, that is, the depth 119 (see FIG. 2) of each respective deep key geometry, comprises a range of about eight to about twenty five percent of the x-axis dimension of the entire block.

As may be further noted with reference to FIGS. 1 thru 3, the block further includes a plurality of vertical cavities 112 and 114 extending through the entire z-axis length thereof, in which said cavities are separated by a web 132. Each cavity includes a rectilinear recess 122 at an upper xy surface 124 of the block, said recess defining, in xz plane cross-section, a shallow U-shaped negative sub-platform, homologous with said recess 122, beneath and co-parallel with said xy top surface 126 of the block 100 in which a vertical z-axis of said web 132 begins at top 134 thereof. An opposite and lower xy surface 126 of the block (see FIG. 2) includes an integrally projecting positive sub platform 123 which is co-parallel with said negative sub-platform 122 of the upper xy surface 124 of the structure. Said positive sub-platform is complementally interlockable with vertically contiguous like blocks within a resultant wall system. As may be noted, said vertical z-axis of web 132 ends at edge 135 and is within a central x-axis bottom recess 25 of the block 100. It is further noted that each of said sub-platforms 122 and 123 exhibit a z-axis dimension which is in a range of about five to about twenty-five percent of the x-axis dimension of the block. In a preferred embodiment of the invention web 132 will taper downwardly from a greater to a lesser y-axis width (see FIG. 3).

Figure 6:
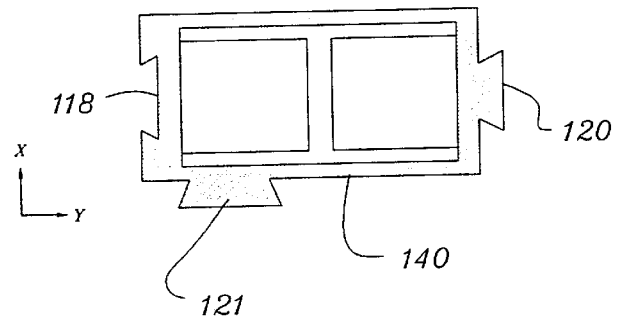
FIG. 6 is a horizontal cross-sectional view taken through Line 6—6 of FIG. 4.
Figure 5:
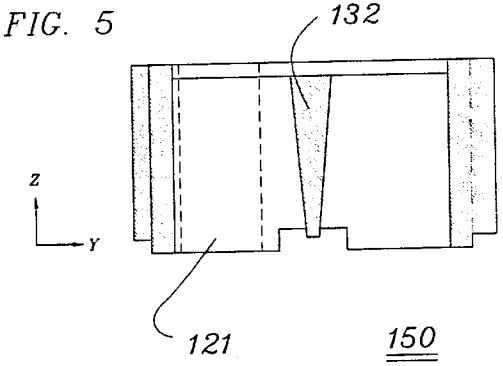
FIG. 5 is a vertical cross-sectional view taken through Line 5—5 of FIG. 4.
Figure 4:
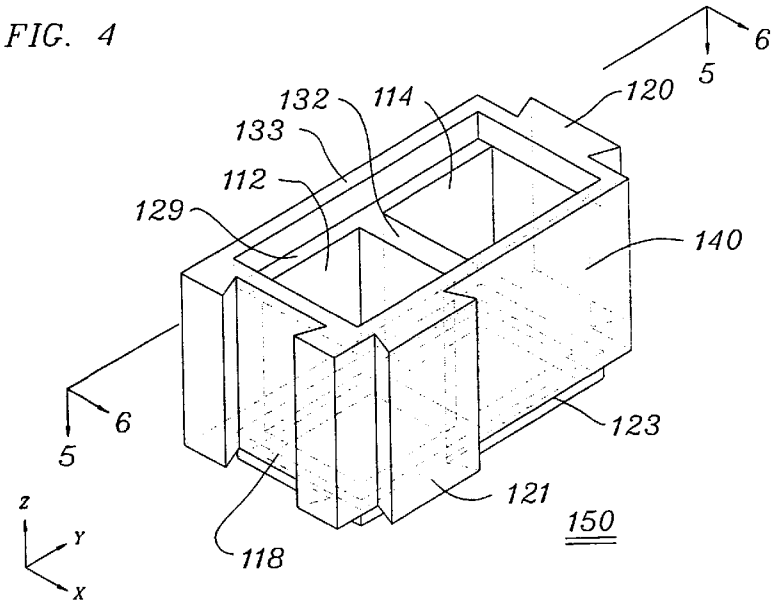
FIG. 4 is a perspective view of a first variation of the embodiment of FIGS.

In FIGS. 4 to 6 is shown a variation of the embodiment of FIGS. 1–3, in which an x-axis deep key geometry 121 projects from at least one yz wall 140 of block 150. In all other respects this embodiment is identical to that of FIGS. 1 to 3.

Figure 9:
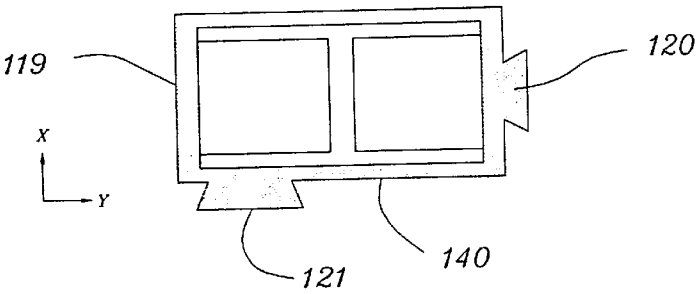
FIG. 9 is a horizontal cross-sectional view through Line 9—9 of FIG. 7.
Figure 8:
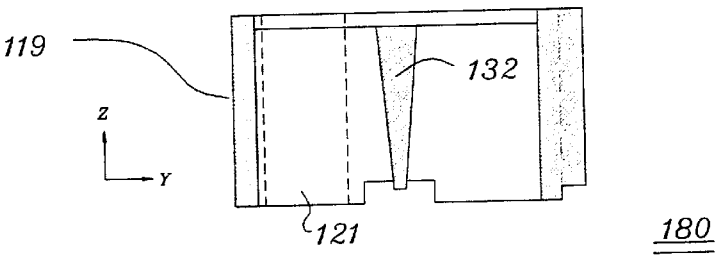
FIG. 8 is a vertical cross-sectional view taken through Line 8—8 of FIG. 7.
Figure 7:
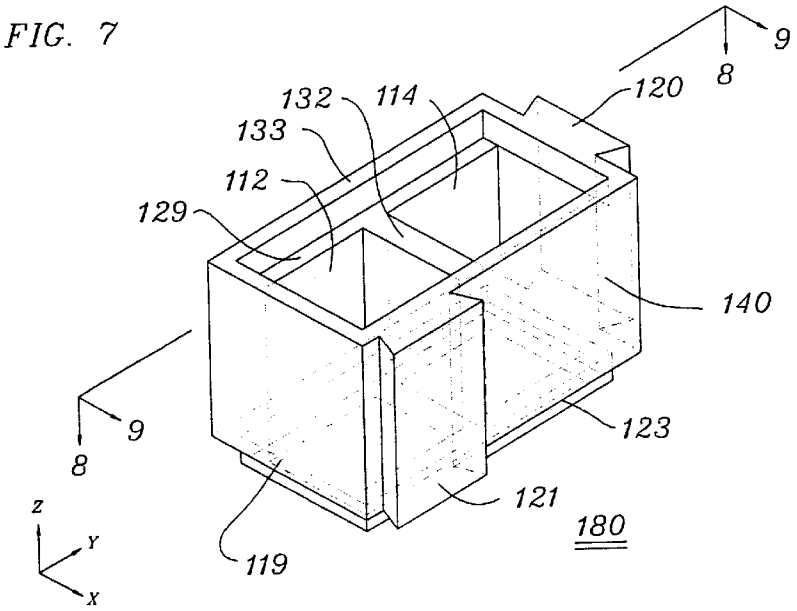
FIG. 7 is a perspective view of a second variation of the embodiment of FIGS. 1–3.

With reference to FIGS. 7 thru 9 is shown a second variation 180 of the above embodiments in which, relative to the embodiment of FIGS. 4 to 6, the only change is that deep key geometry 118 has been eliminated in favor of a flat xz end wall 119. All other respects of the embodiment of FIGS. 7 through 9 are identical to that of FIGS. 4 to 6 as described above.

Figure 12:
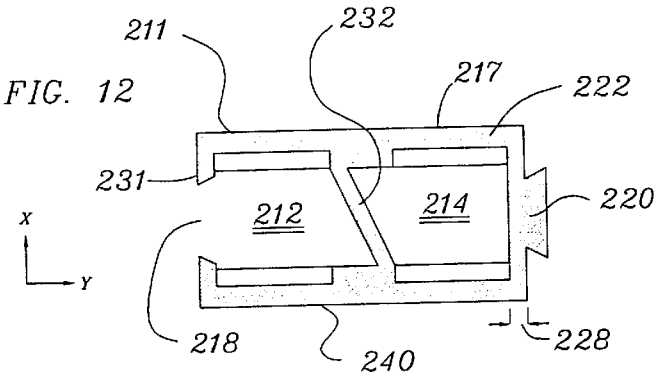
FIG. 12 is a horizontal cross-sectional view taken through Line 12—12 of FIG. 10.
Figure 11:
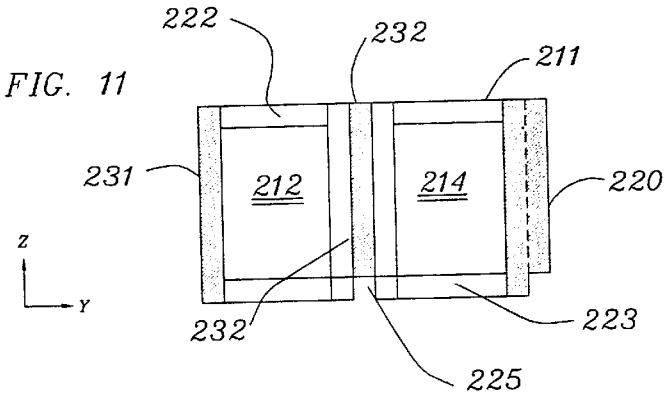
FIG. 11 is a vertical cross-sectional view taken through Line 11—11 of FIG. 10.
Figure 10:
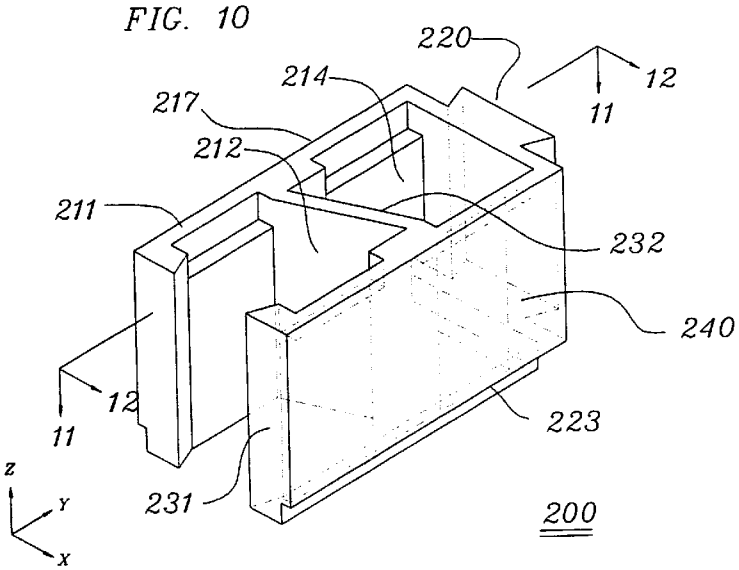
FIG. 10 is a perspective view of a second embodiment of the instant invention.
Figure 10A:
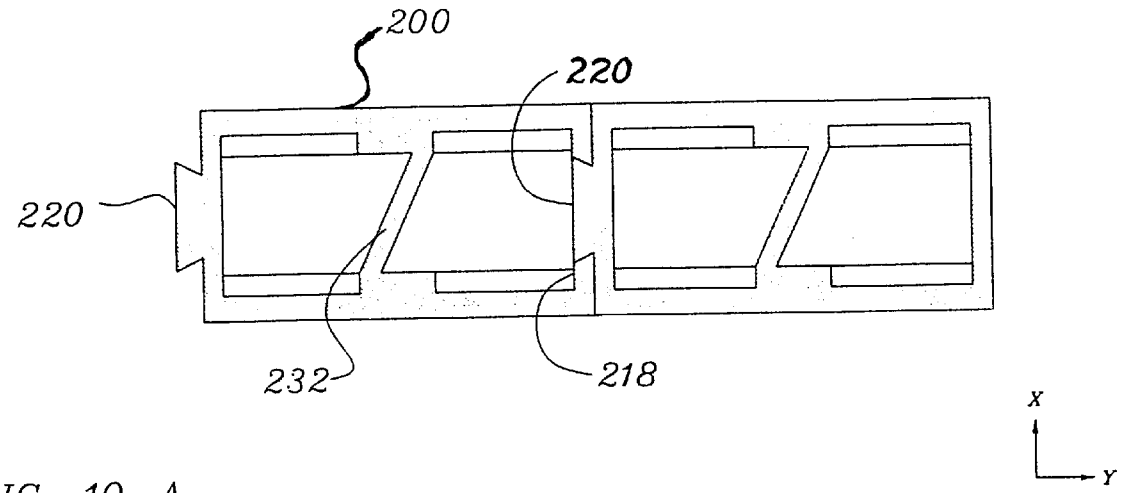
FIG. 10A is a top view of the embodiment of FIG. 10.
Figure 10B:
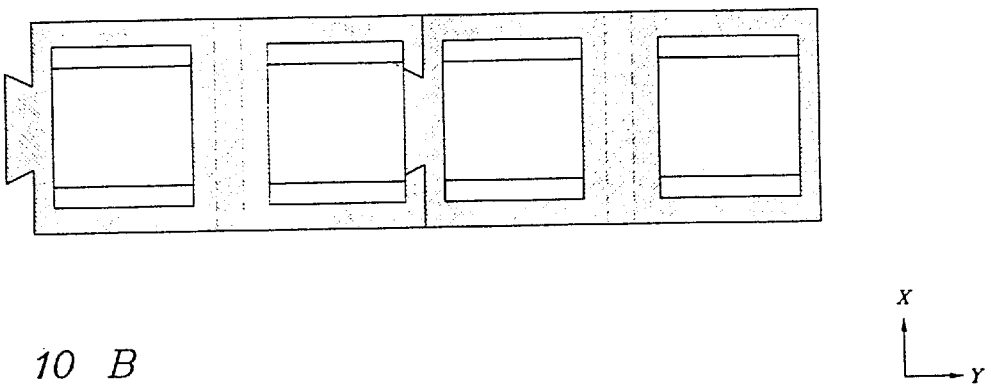
FIGS. 10B and 13A to 13C are views of a further variation of the embodiment of FIGS. 10–12.

With reference to the embodiment FIGS. 10–12, constructional component 200 thereof is characterized by a web 232 which is diagonal relative to y-axis edges 211 of the structure. Further, the embodiment of FIGS. 10 through 12 is characterized by a negative deep key geometry 218 which extends through the entire y-axis of the width of wall 231 of the block. Thereby, the interlock between contiguous y-axis blocks within a resulting wall structure will be that of positive deep key geometries 220 complementally interlocking with negative geometries 118 of other blocks in the manner shown in FIG. 10A herewith. Thereby, the y-axis interlock between contiguous blocks of a wall structure will be deeper and stronger than that resultant from such interlocks achieved in the above embodiments of FIGS. 1 through 9. Also, enhanced resistance and compressibility of the structure relative to lateral, that is, x-axis loads, both uniform and cyclical, may be achieved through the embodiments of FIGS. 10 thru 12. This embodiment, in other aspects, is similar to that of the above embodiments, namely, there is provided a positive y-axis geometry, recesses 222 in vertical cavities 212 and 214, as well as x-axis projections 223 proportioned for complemental z-axis interlock with contiguous like blocks of the resultant wall system.

Figure 15:
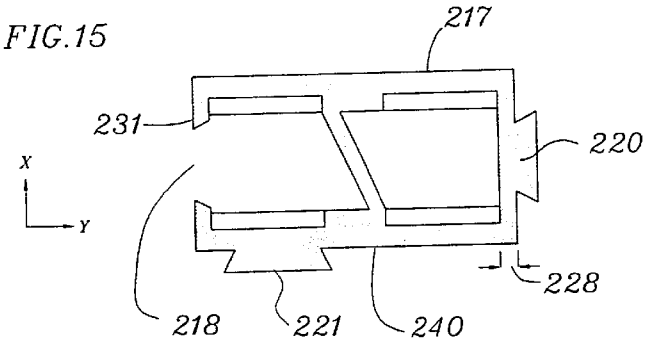
FIG. 15 is a horizontal cross-sectional view taken through Line 15—15 of FIG. 13.
Figure 14:
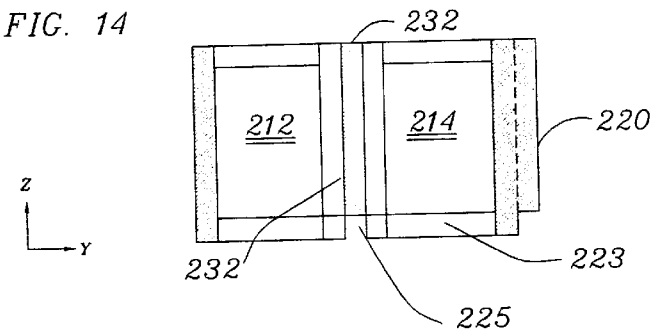
FIG. 14 is a vertical cross-sectional view taken through Line 14—14 of FIG. 13.
Figure 13:
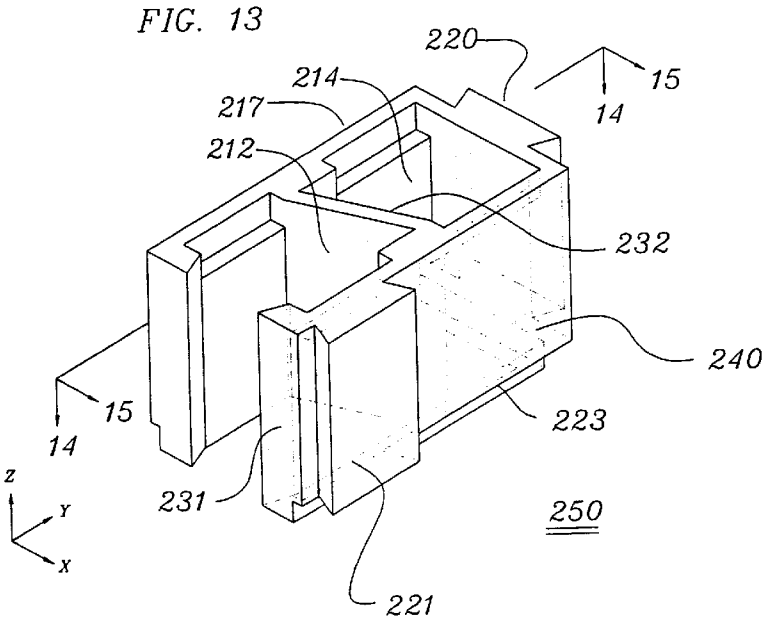
FIG. 13 is a perspective view of a second embodiment of the instant invention.

In FIGS. 13 through 15 is shown a variation of the embodiment of FIGS. 10 through 12 in which there is additionally provided a positive deep key geometry 221 which projects in the positive x-direction off of lateral yz wall 240 of block 250, thereby enabling the formation of a right angle of a resultant wall structure.

Figure 13C:
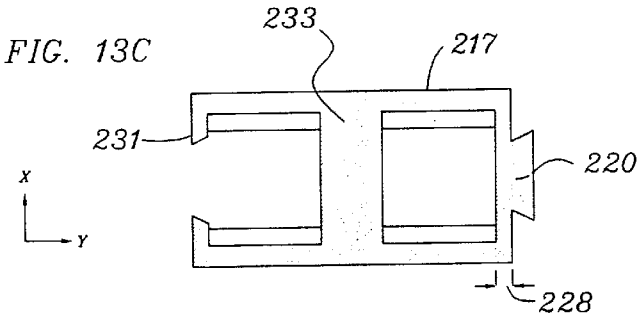
Figure 13B:
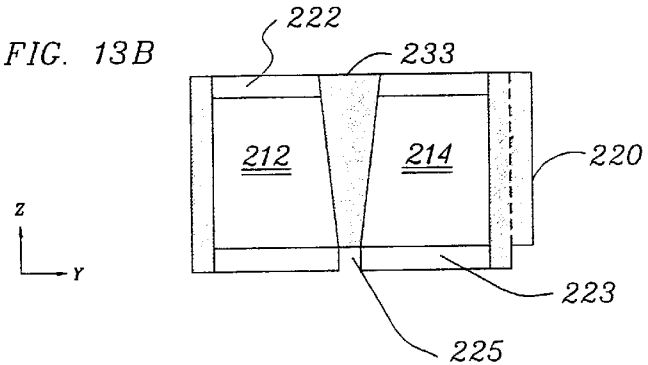
Figure 13A:
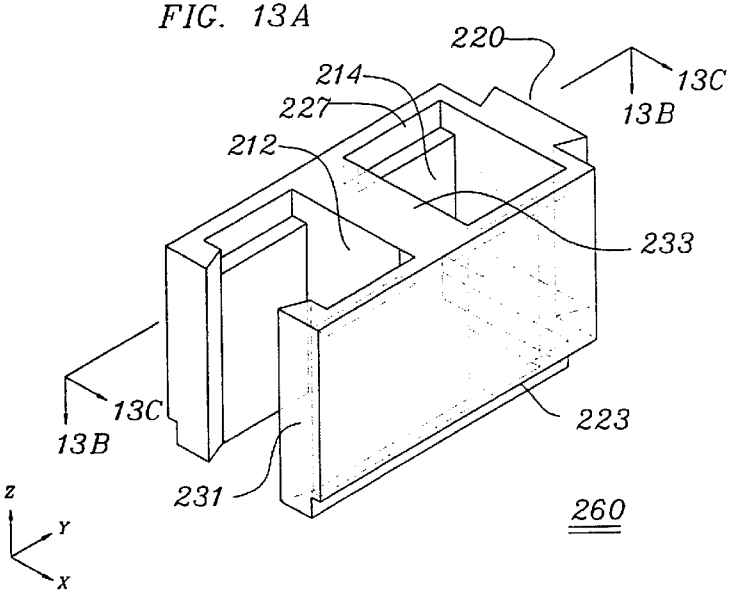

In FIGS. 13A to 13C is shown a further variation of the embodiment of FIGS. 10–12 in which diagonal web 232 of block 200 is replaced by rectilinear web 233 of block 260. As is shown in FIG. 13B, web 233 will preferably taper to a smaller y-axis width at the lower end of the z-axis of the block.

Figure 18:
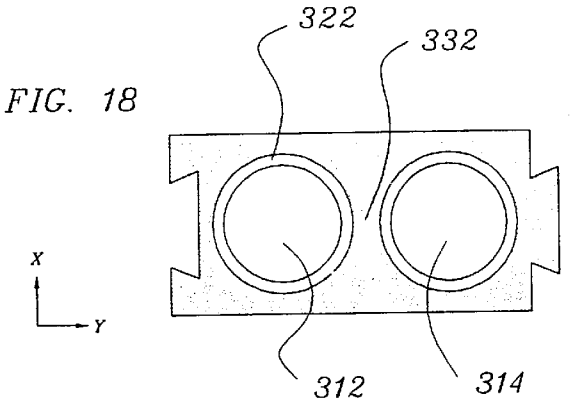
FIG. 18 is a horizontal cross-sectional view taken through Line 18—18 of FIG. 16.
Figure 17:
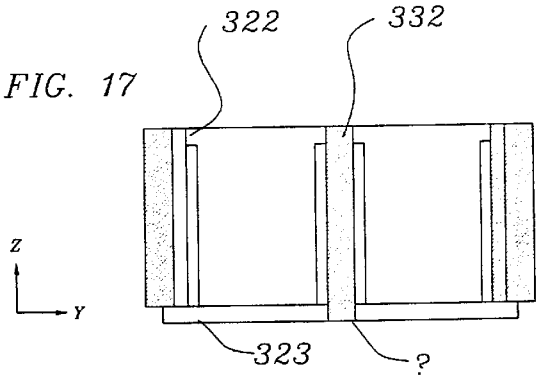
FIG. 17 is a vertical cross-sectional view taken through Line 17—17 of FIG. 16.
Figure 16:
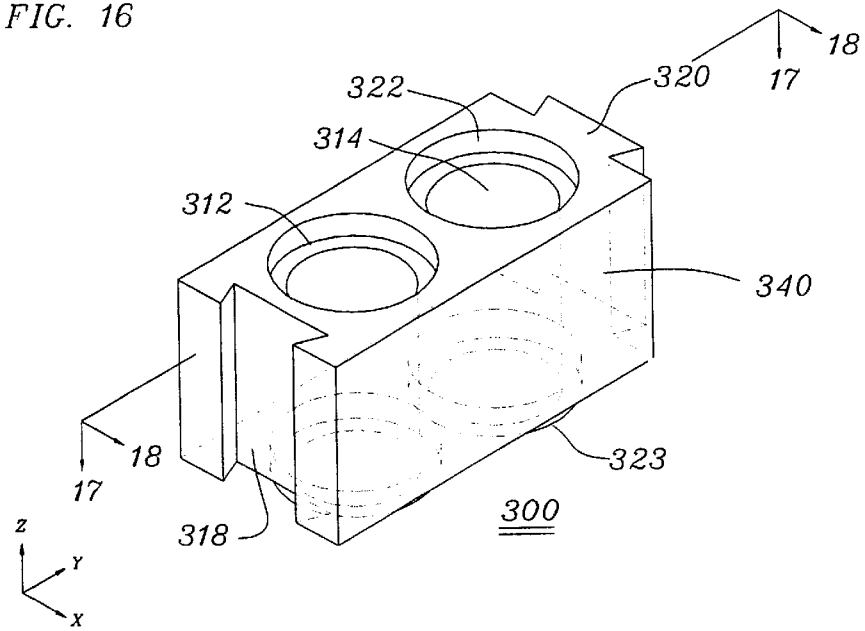
FIG. 16 is a perspective view of a third embodiment of the present invention.

With reference to the embodiment of FIGS. 16 thru 18, a constructional component 300 is generally similar to the embodiment of FIGS. 1 to 3 described above, this with the exception of the vertical cavities which, in the embodiment of FIGS. 16 through 18, take the form of cylindrical or elliptical cavities 312 and 314 which include, at the upper z-axis entrances thereof, circumferential ledges 322, and at the negative z-axis entrance thereof projecting positive circumferential ledges 323. This structure may be more fully seen with reference to vertical cross-sectional view of FIG. 17 and the horizontal cross-sectional view of FIG. 18. Said positive circumferential ledge 323 is proportioned for complemental interlock with negative circumferential ledges 322 of contiguous z-axis blocks within a resulting wall structure.

Figure 21:
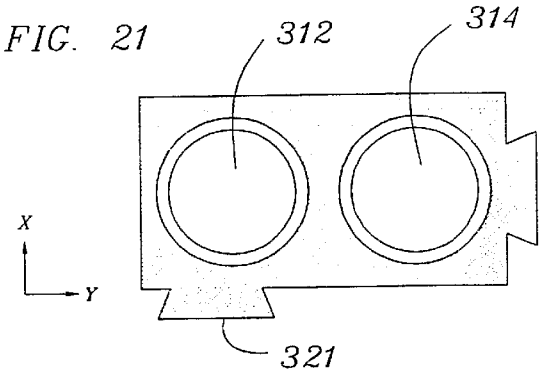
FIG. 21 is a horizontal cross-sectional view taken through Line 21–21 of FIG. 19.
Figure 20:
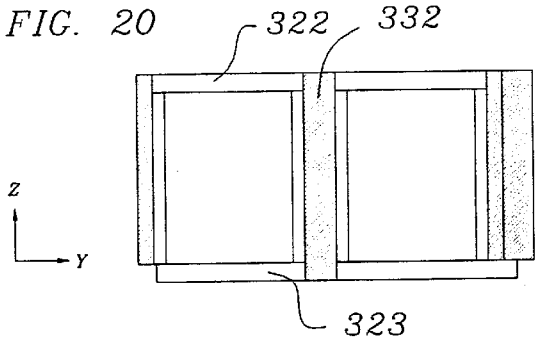
FIG. 20 is a vertical cross-sectional view taken through Line 20—20 of FIG. 19.
Figure 19:
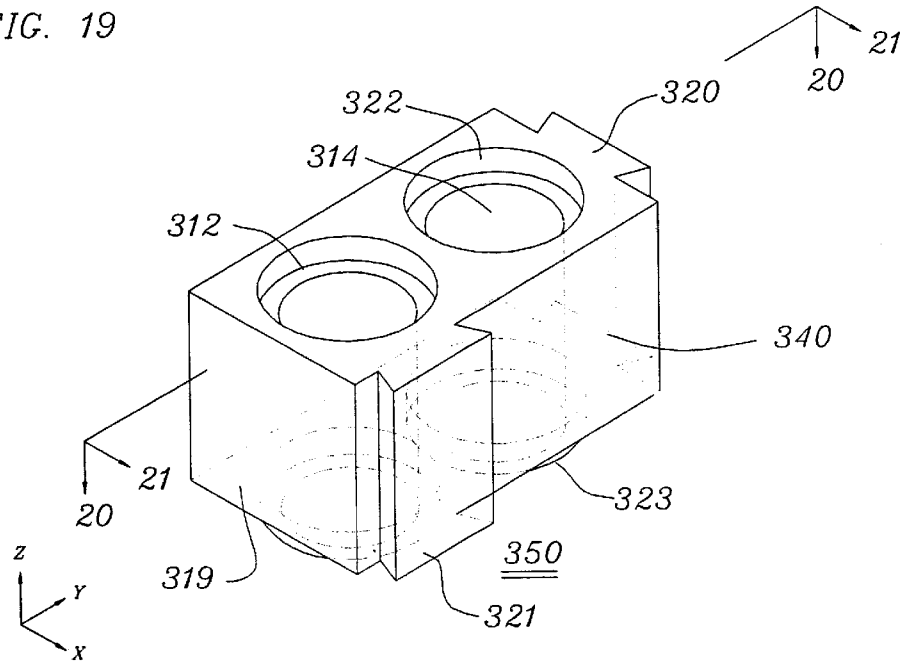
FIG. 19 is a perspective view of a variation of the embodiment of FIGS. 16–18.

In FIGS. 19 to 21 is shown a variation of the embodiment of FIGS. 16 through 18 which differs therefrom only in the elimination of negative y-axis geometry 318 of the block 300 in favor of positive x-axis geometry 321 of block 350. That is, block 350, at one xz surface thereof 319 is entirely flat while, at one yz surface 340 thereof exhibits said projecting positive x-axis deep key geometry 321.

Figure 22:
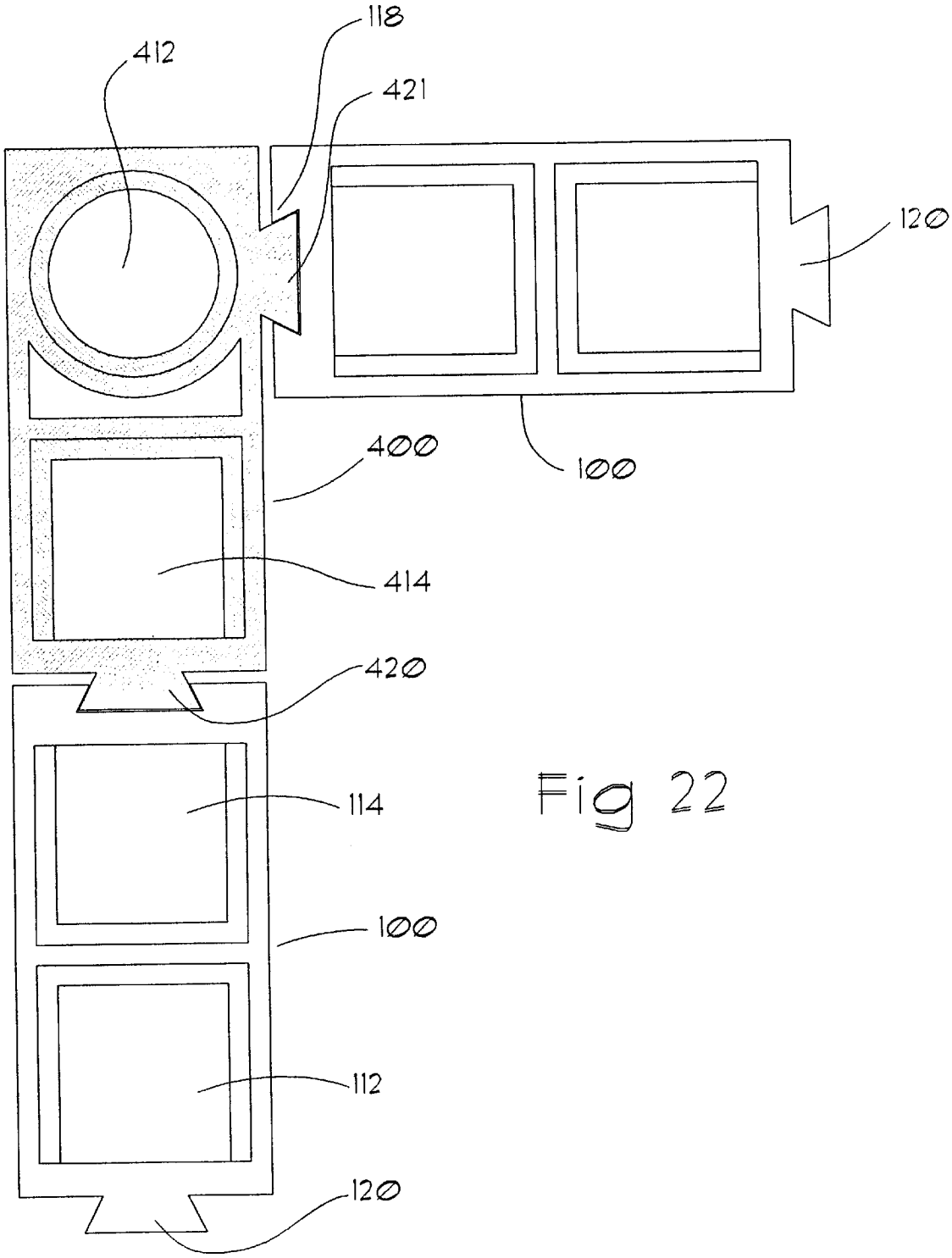
FIGS. 22 and 23 are respective top and bottom plan views showing complemental horizontal interlock of constructional blocks of one embodiment of the invention with constructional blocks of another embodiment of the invention.
Figure 23:
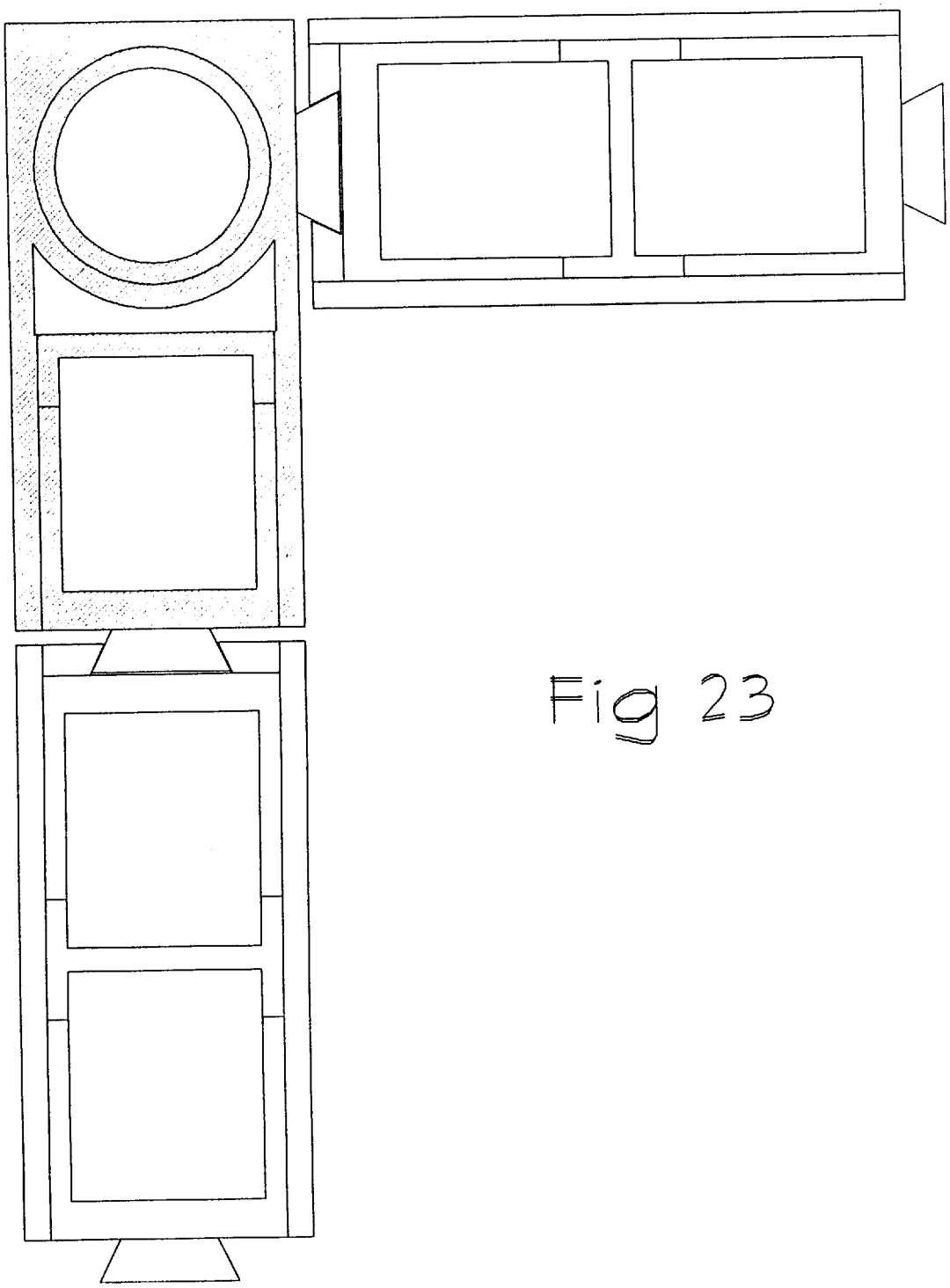

In the top and bottom plan views of FIGS. 22 and 23 respectively are shown the manner in which different embodiments of the invention, for example, the embodiment of FIGS. 1 to 3 may be employed within a resultant wall structure in combination with other embodiments. At the upper left corner of FIGS. 22 and 23 is shown a use of the present invention representing an integration of the embodiment of FIGS. 1 to 3 with a version of the embodiment of FIGS. 19 thru 22, this is, rectilinear, cylindrical or elliptical vertical cavities, for example, 414 and 412 may be integrated within a single block 400 and may include a positive x-axis interlock 421 for purposes of interlock with a negative axis geometry 118 of a block of the embodiments of FIGS. 1 to 3.

Figure 26:
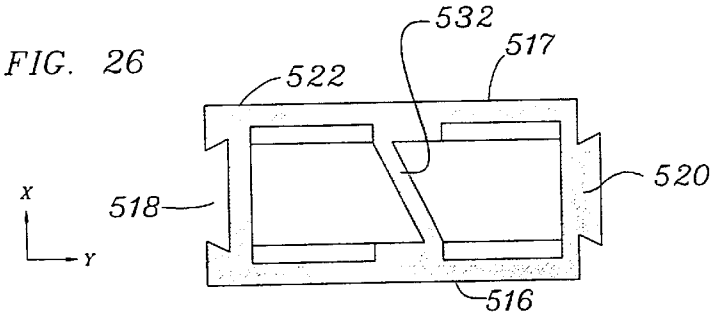
FIG. 26 is a horizontal cross-sectional view through Line 26—26 of FIGS. 24–26.
Figure 25:
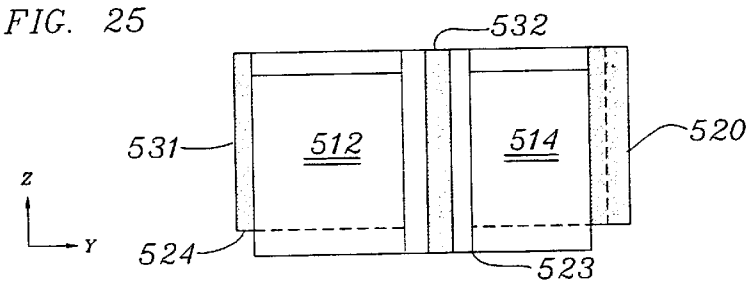
FIG. 25 is a vertical cross-sectional view taken through Line 25—25 of FIG. 24.
Figure 24:
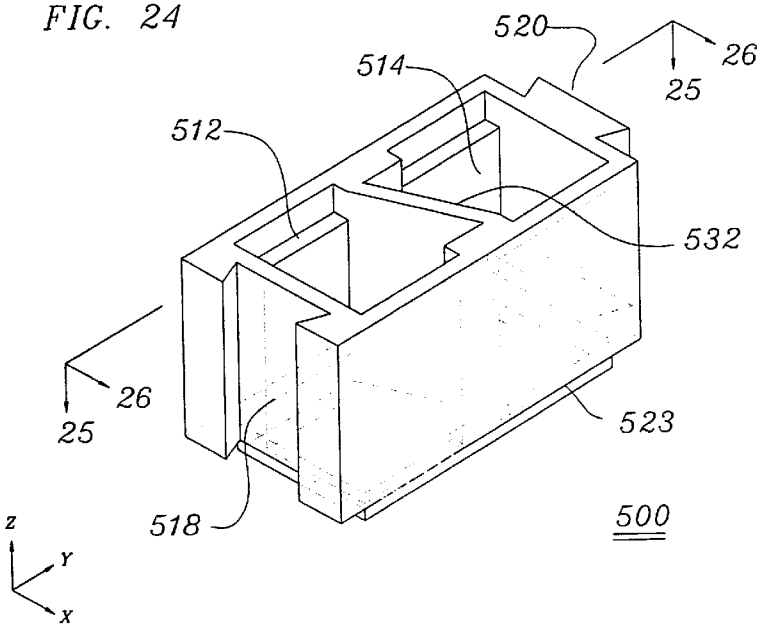
FIG. 24 is a perspective view of a fourth embodiment of the present invention.
Figure 29:
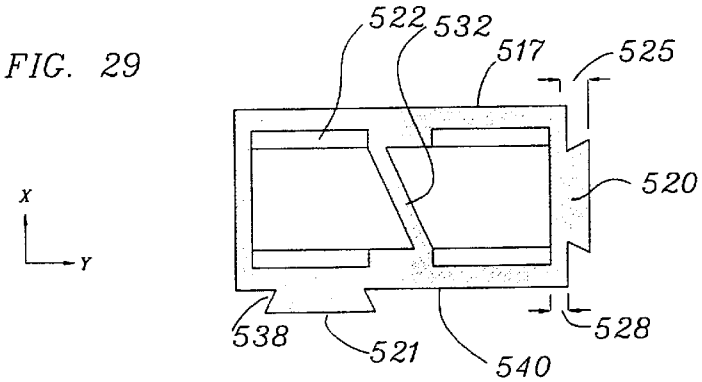
FIG. 29 is a horizontal cross-sectional view taken through Line 29—29 of FIG. 27.
Figure 28:
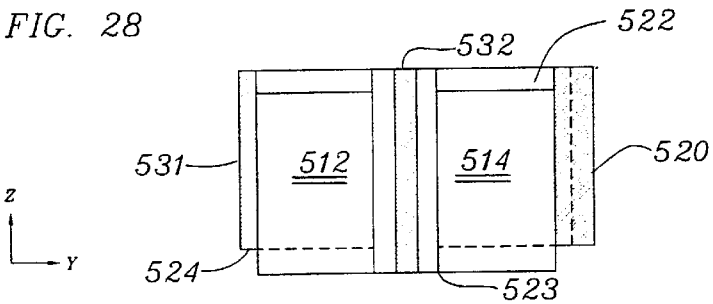
FIG. 28 is a vertical cross-sectional view taken through Line 28—28 of FIG. 27.
Figure 27:
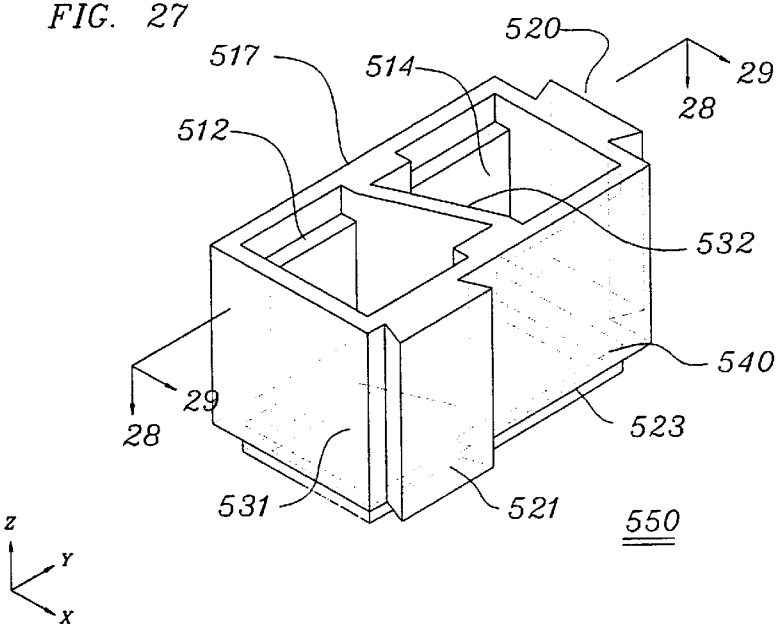
FIG. 27 is a perspective view of a variation of the embodiment of FIG. 24.

With reference to FIGS. 24 through 26, there is shown a variation of the embodiment of FIGS. 1 to 3 in which the web thereof is replaced by a diagonal web portion 532 in block 500 to provide a greater x-axis durability. A variation thereof is shown in FIGS. 27 through 29 which, generally, correspond to the embodiment of FIGS. 4 thru 6. That is, vertical web portion 532 is again substituted for vertical web portion 132. With respect to positive deep key geometries 520 and 521, negative upper ledges 522, and complemental positive lower projections 523.

In view of the above, it is to be appreciated that there exist a number of variables which, through different permutations thereof, can produce any of the embodiments above-described, that is, through variation of the position of the respective positive and negative interlocks, the geometry of the vertical web, and a determination of whether a negative deep key interlock of the type of 118 (see FIG. 1) or 318 (see FIG. 16) is used in lieu of a negative deep key interlock of the type of 218 of block 200 or 250 (see FIGS. 10 thru 15). As above noted, a negative deep key interlock of the type of FIGS. 10 thru 15 is one which extends through the entire y-axis of one xz wall of the block 200 or 250 thereby enabling a deeper and closer engagement of contiguous blocks when interlocked within the y-axis of a resulting wall system. Further, each of the above embodiments also provides for z-axis interlock while providing for a substantial rigid interlock between both horizontally and vertically contiguous blocks when joined as components of a wall system.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. A constructional component for a wall system definable in an xyz Cartesian coordinate system capable of resisting high gravity and lateral loads, both uniform and cyclical, the component comprising:

a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface of each building block comprises a positive y-axis deep key geometry and each opposing xz end surface thereof comprises a negative y-axis deep key geometry complementally interlockable to said positive geometry of an opposite xz surface, in which a ratio, of the x-axis width of a base of each positive and negative deep key geometry of each opposing xz end surface, comprises at least twenty percent of the entire x-axis width of each block, in which each y-axis deep key dimension of said respective deep key geometries comprises a range of about eight to about twenty five percent of the x-axis dimension of said block, in which said block includes a plurality of vertical cavities extending through the entire z-axis length thereof, said cavities separated by a web portion, said cavities each including (i) a rectilinear recess at an upper xy surface of said block, said recess defining, in a xz plane cross section, a shallow U-shaped negative sub-platform, homologous with said recess, beneath and co-parallel with an xy top surface of said block, in which a vertical z-axis of said web begins at said negative sub-platform, and (ii) an opposite and lower xy surface of said block, at an opposite end z-axis end of said web, having an integral projecting positive sub-platform co-parallel with said negative sub-platform and complementally interlockable into adjoining negative sub-platforms of like blocks of vertically adjacent courses of blocks within said wall structure, each of said sub-platforms having a z-axis dimension in a range of about five to about twenty five percent of the x-axis dimension of said block, whereby a substantially rigid and load-resistant interlock between horizontally and vertically contiguous blocks, when joined as a component of a wall system, is resultant therefrom.

2. The constructional component as recited in claim 1 in which said positive sub-platform defined at said lower xy surface of said block includes a central x-axis recess for complemental engagement of a web of a vertically adjoining negative sub-platform of a vertically adjacent course of blocks.

3. The component as recited in claim 2 in which said web tapers from greater to lesser y-axis width from top to bottom of said block.

4. The component as recited in claim 2 in which said block further comprises a positive x-axis deep key geometry integrally projecting from at least one yz wall of said block.

5. The component as recited in claim 4 in which said block further comprises a positive z-axis deep key geometry integrally projecting from at least one yz wall of said block.

6. A constructional component for a wall system definable in an xyz Cartesian coordinate system capable of resisting high gravity and lateral loads, both uniform and cyclical, the component comprising:

a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface and one yz end surface of each building block comprises a positive y-axis deep key geometry, each of said geometries complementally interlockable to a negative geometry of an opposite surface, in which a ratio, of the width of a base of each positive deep key geometry to a width of each opposing xz end surface, comprises at least twenty percent of the entire x-axis width of each block, in which each y-axis deep key dimension of said respective deep key geometries also comprises a range of about eight to about twenty five percent of the x-axis dimension of said block, in which said block includes a plurality of vertical cavities extending through the entire z-axis length thereof, said cavities separated by a web portion, said cavities each including (i) a rectilinear recess at an upper xy surface of said block, said recess defining, in a xz plane cross section, a shallow U-shaped negative sub-platform, homologous with said recess, beneath and co-parallel with an xy top surface of said block, in which a vertical z-axis of said web begins at said negative sub-platform, and (ii) an opposite and lower xy surface of said block, at an opposite end z-axis end of said web, having an integral projecting positive sub-platform co-parallel with said negative sub-platform and complementally interlockable into adjoining negative sub-platforms of like blocks of vertically adjacent courses of blocks within said wall structure, each of said sub-platforms having a z-axis dimension in a range of about five to about twenty five percent of the x-axis dimension of said block, whereby a substantially rigid and load-resistant interlock between horizontally and vertically contiguous blocks, when joined as a component of a wall system, is resultant therefrom.

7. The constructional component as recited in claim 6 in which said positive sub-platform defined at said lower xy surface of said block includes a central x-axis recess for complemental engagement of a web of a vertically adjoining negative sub-platform of a vertically adjacent course of blocks.

8. The component as recited in claim 7 in which said web portion in a xy plane, defines a diagonal relative to y-axis edges of said block.

9. The constructional component as recited in claim 1 in which said negative deep key geometry of said xz end surface includes a part of a y-axis length of said block, whereby a positive deep key geometry of an opposing xz end surface mates with said negative geometry of said xz end wall of said block.

10. The constructional component as recited in claim 1 in which said positive sub-platform defined at said lower xy surface of said block includes a central x-axis recess for complemental engagement of a web of a vertically adjoining negative sub-platform of a vertically adjacent course of blocks.

11. The constructional component as recited in claim 1, in which said negative sub-platform comprises ledges thereof at the top of said z-axis web, said ledges comprising two xy plane offsets, and said cavities define opposing xz planes in which no ledges exist.

12. The constructional component as recited in claim 9, in which said negative sub-platform comprises ledges thereof at the top of said z-axis web, said ledges comprising two xz plane offsets, and said cavities define opposing xz planes in which no ledges exist.

13. The constructional component as recited in claim 1 in which at least one yz end surface of said block comprises a positive x-axis deep key geometry, in which a greatest y-axis width of a base thereof comprises about at least twenty percent of an entire x-axis width of each block.

14. The constructional component as recited in claim 4 in which at least one yz end surface of said block comprises a positive x-axis deep key geometry, in which a greatest y-axis width of a base thereof comprises about at least twenty percent of an entire x-axis width of each block.

15. The constructional component as recited in claim 4 in which said negative deep key geometry of said yz surface comprises an outward trapezoid relative to said cavities.

16. A constructional component for a wall system definable in an xyz Cartesian coordinate system capable of resisting high gravity and lateral loads, both uniform and cyclical, the component comprising:

a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface of each building block comprises a positive y-axis deep key geometry and each opposing xz end surface thereof comprises a negative y-axis deep key geometry extending through an entire y-axis of the width of a wall of said xz end surface, said negative geometry complementally interlockable to said positive geometry of an opposite xz surface, in which a ratio, of the x-axis width of a base of each positive and negative deep key geometry of each opposing xz end surface, comprises at least twenty percent of the entire x-axis width of each block, in which each y-axis deep key dimension of said respective deep key geometries also comprises a range of about eight to about twenty five percent of the x-axis dimension of said block, in which said block includes a plurality of vertical cavities extending through the entire z-axis length thereof, said cavities separated by a web portion.

17. The component as recited in claim 16, in which said web portion, in a xy plane, defines a diagonal relative to y-axis edges of said block.

18. The component as recited in claim 17 in which said block further comprises a positive x-axis deep key geometry integrally projecting from at least one yz wall of said block.

19. The component as recited in claim 17, in which upper and lower xy surfaces of said block are complementally interlockable with each other.

20. A constructional component for a wall system structure definable in an xyz Cartesian coordinate system capable of resisting high gravity and lateral loads, both uniform and cyclical, the component comprising:

a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface of each building block comprises a positive y-axis deep key geometry and each opposing xz end surface thereof comprises a negative y-axis deep key geometry complementally interlockable to said positive geometry of an opposite xz surface, in which a ratio of the x-axis width of a base of each positive and negative deep key geometry of each opposing xz end surface comprises at least twenty percent of the entire y-axis width of each block, in which each y-axis deep key dimension of said respective deep key geometries also comprises a range of about eight to about twenty-five percent of the x-axis dimension of said block, in which said block includes at least one vertical axis cylindrical cavity including (i) a circular ledge and an upper xy surface of said block, said ledge defining a circular negative sub-platform beneath said xy upper surface, and (ii) a circumferential ledge at each opposite lower xy surface of said block from which projects a complemental positive sub-platform, co-parallel to said negative sub-platform, said positive platform interlockable into adjoining negative sub platforms of like blocks of vertically adjacent courses of block within said wall structure, each of said sub-platforms having a z-axis dimension in a range of about five to about twenty five percent of the x-axis dimension of said block, whereby a substantially rigid and load-resistant interlock between horizontally and vertically contiguous blocks, when joined as a component of a wall system, is resultant therefrom.

21. A constructional component as recited in claim 20 further in which at least one yz end surface of said block comprises a positive x-axis deep key geometry in which a greatest y-axis width of a base thereof comprises about at least twenty percent of an entire x-axis width of each block.

22. A constructional component for a wall system structure definable in an xyz Cartesian coordinate system capable of resisting high gravity and lateral loads, both uniform and cyclical, the component comprising:

a solid building block, formed of a constructional material, having a generally rectangular exterior configuration definable in said xyz Cartesian coordinate system, an x-axis thereof defining a width axis of said wall structure, a y-axis thereof defining the directionality of said wall structure, and a z-axis thereof defining a vertical axis of the wall structure, in which one xz end surface of each building block comprises a positive y-axis deep key geometry and each opposing xz end surface thereof comprises a negative y-axis deep key geometry complementally interlockable to said positive geometry of an opposite xz surface, in which a ratio of the x-axis width of a base of each positive and negative deep key geometry of each opposing xz end surface comprises at least twenty percent of the entire y-axis width of each block, in which each y-axis deep key dimension of said respective deep key geometries also comprises a range of about eight to about twenty-five percent of the x-axis dimension of said block, in which said block includes at least one vertical axis cylindrical cavity including (i) a circular ledge and an upper xy surface of said block, said ledge defining a circular negative sub-platform beneath said xy upper surface, and (ii) a circumferential ledge at each opposite lower xy surface of said block from which projects a complemental positive sub-platform, co-parallel to said negative sub-platform, said positive platform interlockable into adjoining negative sub platforms of like blocks of vertically adjacent courses of block within said wall structure, each of said sub-platforms having a z-axis dimension in a range of about five to about twenty five percent of the x-axis dimension of said block, whereby a substantially rigid and load-resistance interlock between horizontally and vertically contiguous blocks, when joined as a component of said wall structure, is resultant therefrom.

23. The component as recited in claim 22 further in which at least one yz end surface of said block comprises a positive x-axis deep key geometry in which a greatest y-axis width of a base thereof comprises at least twenty percent of an entire x-axis width of each block.

24. The component as recited in claim 23 in which said block further comprises at least one yz surface comprising a positive x-axis deep key geometry complementally interlockabe with contiguous x-axis blocks of said wall system.

25. The component as recited in claim 21 in which said block includes at least one vertical rectilinear cavity extending thru the z-axis of said block.

26. A constructional component for a wall structure definable in an xyz Cartesian and system, capable of resisting high gravity and lateral loads, both uniform and cyclical, the component comprising:

a solid building block formed of a structural material, having a generally rectangular exterior configuration definable in said xyz Cartesian coordinate system, an x-axis thereof comprising a width axis of said wall structure, a y-axis thereof comprising the directionality of said wall structure, and a z-axis thereof comprising a vertical axis of the wall structure, in which one xz end surface of each building block comprises a positive y-axis deep key geometry and each opposing xz end surface thereof comprises a negative y-axis deep key geometry complementally interlockable to said positive geometry of said opposite xz surface, in which each y-axis deep key dimension of said respective positive and negative deep key geometries comprises a range of eight to twenty-five percent of the x-axis dimension of said block in which said block, in which said block includes a plurality of vertical cavities extending the entire z-axis length therethrough, said cavities separated by a web portion, said web portion, in an xy plane, defining a diagonal relative to y-axis edges of said block, said cavities each comprising rectilinear interior edges, at xy surfaces thereof, said ledges comprising respectively negative and positive complementally interlockable structures each having a z-axis dimension in the range of five to twenty-five percent of the x-axis dimension of the block, whereby, a substantially rigid and load resilient interlock between horizontally and vertically contiguous blocks when joined as components of a wall structure resultant therefrom.

27. The constructional component as recited in claim 26 in which said ledges of said vertical cavity comprise two-dimensional offsets in which no ledge exists at opposing xz surfaces of each cavity.

28. The constructional components as recited in claim 20, in which said cylindrical cavity comprises an elliptical cavity.

* * * * *